US010509344B2

(12) United States Patent
Kimura

(10) Patent No.: US 10,509,344 B2
(45) Date of Patent: Dec. 17, 2019

(54) IMAGE FORMING APPARATUS AND PROGRAM EXECUTED BY COMPUTER OF IMAGE FORMING APPARATUS

(71) Applicant: Konica Minolta Inc., Tokyo (JP)

(72) Inventor: Masato Kimura, Toyoake (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/163,018

(22) Filed: Oct. 17, 2018

(65) Prior Publication Data

US 2019/0129334 A1 May 2, 2019

(30) Foreign Application Priority Data

Oct. 27, 2017 (JP) ..... 2017-207899

(51) Int. Cl.

| | |
|---|---|
| ***G03G 15/16*** | (2006.01) |
| ***B41J 2/385*** | (2006.01) |
| ***G03G 15/043*** | (2006.01) |
| ***G03G 15/02*** | (2006.01) |
| ***G03G 15/06*** | (2006.01) |

(Continued)

(52) U.S. Cl.

CPC ..... *G03G 15/169* (2013.01); *B41J 2/385* (2013.01); *G03G 15/02* (2013.01); *G03G 15/0266* (2013.01); *G03G 15/0275* (2013.01); *G03G 15/0283* (2013.01); *G03G 15/043* (2013.01); *G03G 15/045* (2013.01); *G03G 15/047* (2013.01); *G03G 15/065* (2013.01); *G03G 15/5033* (2013.01); *G03G 21/0094* (2013.01);

(Continued)

(58) Field of Classification Search

CPC ..... G03G 15/0266; G03G 15/0275; G03G 15/0283; G03G 15/043; G03G 15/045; G03G 15/047; G03G 15/065; G03G 15/5033; G03G 21/0094; G03G 21/06; G03G 21/08

See application file for complete search history.

(56) References Cited

U.S. PATENT DOCUMENTS

| | | | | |
|---|---|---|---|---|
| 2003/0016961 | A1* | 1/2003 | Kitajima | G03G 15/0266 399/50 |
| 2011/0221847 | A1* | 9/2011 | Takezawa | G03G 15/043 347/118 |
| 2016/0291503 | A1* | 10/2016 | Kudoh | G03G 15/08 |

FOREIGN PATENT DOCUMENTS

| | | | |
|---|---|---|---|
| JP | 2006017909 | A | 1/2006 |
| JP | 2008008991 | A | 1/2008 |

* cited by examiner

*Primary Examiner* — Joseph S Wong
(74) *Attorney, Agent, or Firm* — Lucas & Mercanti, LLP

(57) ABSTRACT

An electrophotographic image forming apparatus includes: an image carrier that carries and conveys a toner image; a charging member arranged in contact with or close to the image carrier; a charging power supply that charges the image carrier; an exposurer that forms a latent image on the charged image carrier; a developing member arranged close to the image carrier; a developing power supply that develops the latent image and forms a toner image on the image carrier; a transfer member that transfers the toner image to a medium; and a hardware processor that controls the image forming apparatus, wherein the hardware processor obtains a potential of an exposure part and a non-exposure part, on the image carrier after the toner image has been transferred to the medium, determines a charging bias based on a difference between the obtained potentials, and determines a developing bias based on the determined charging bias.

17 Claims, 11 Drawing Sheets

(51) Int. Cl.

| | |
|---|---|
| ***G03G 21/06*** | (2006.01) |
| ***G03G 15/045*** | (2006.01) |
| ***G03G 21/08*** | (2006.01) |
| ***G03G 21/00*** | (2006.01) |
| ***G03G 15/00*** | (2006.01) |
| ***G03G 15/047*** | (2006.01) |

(52) U.S. Cl.
CPC ..... *G03G 21/06* (2013.01); *G03G 21/08* (2013.01); *G03G 15/5008* (2013.01)

IMAGE FORMING APPARATUS AND PROGRAM EXECUTED BY COMPUTER OF IMAGE FORMING APPARATUS

The entire disclosure of Japanese patent Application No. 2017-207899, filed on Oct. 27, 2017, is incorporated herein by reference in its entirety.

BACKGROUND

Technological Field

The present disclosure relates to an image forming apparatus, and more specifically, to an electrophotographic image forming apparatus.

Description of the Related Art

Regarding an electrophotographic image forming apparatus, "image memory" in which non-uniformity of surface potentials of an image carrier according to previous printing affects the current printing has been known. The image memory is a phenomenon which hinders uniformization of an image density.

Regarding a technique for reducing the image memory, for example, JP 2006-017909 A discloses a technique in which "after a surface potential of an image part of an image carrier receives charge injection from an intermediate transfer member at the time of transferring a toner image and changed by the charge means until the procedure proceeds to the next image forming cycle, an applied voltage to the intermediate transfer member is set so that the surface potential of the image part becomes 95% to 105% of a surface potential of a non-image part of the image carrier" (refer to "Abstract").

In addition, JP 2008-008991 A discloses a technique "for driving and controlling a charging device, an exposurer, and a transfer device by changing a difference between a primary charging potential of the charging device and an image forming potential of the exposurer to a value predetermined according to a transfer output of the transfer device" (refer to "Abstract").

However, the technique disclosed in JP 2006-017909 A sets a resistance value of an intermediate transfer member as a means to "set the applied voltage to the intermediate transfer member so as to be the value of 95% to 105% of the surface potential of the non-image part of the image carrier". However, relative to variation in the resistances of the intermediate transfer member caused by manufacturing errors, there is a possibility that the image memory cannot be sufficiently prevented.

Furthermore, the technique disclosed in JP 2008-008991 A may cause a disadvantage caused by the difference between the primary charging potential and the developing potential difference in a case where "the difference between the primary charging potential of the charging device and the image forming potential of the exposurer" is changed. Therefore, a technique is required which sufficiently prevents the image memory and prevents the disadvantage accompanying with the image memory.

SUMMARY

The present disclosure has been made to solve the above problems, and an object of a certain aspect is to provide an image forming apparatus capable of preventing an image memory and other disadvantages.

To achieve the abovementioned object, according to an aspect of the present invention, an electrophotographic image forming apparatus reflecting one aspect of the present invention comprises: an image carrier that is rotatable and carries and conveys a toner image; a charging member that is arranged in contact with or close to the image carrier; a charging power supply that charges the image carrier by applying a charging bias to the charging member; an exposurer that forms a latent image on the charged image carrier; a developing member that is arranged close to the image carrier; a developing power supply that develops the latent image and forms a toner image on the image carrier by applying a developing bias to the developing member; a transfer member that transfers the toner image formed on the image carrier to a medium by receiving an applied transfer bias; and a hardware processor that controls the image forming apparatus, wherein the hardware processor obtains a potential of an exposure part where the latent image is formed and a potential of a non-exposure part where the latent image is not formed, on the image carrier after the toner image has been transferred to the medium, determines the charging bias based on a difference between the obtained potentials of the exposure part and the non-exposure part so that a potential on the image carrier becomes uniform after the toner image has been transferred to the medium, and determines the developing bias based on the determined charging bias.

BRIEF DESCRIPTION OF THE DRAWINGS

The objects, advantages, aspects, and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
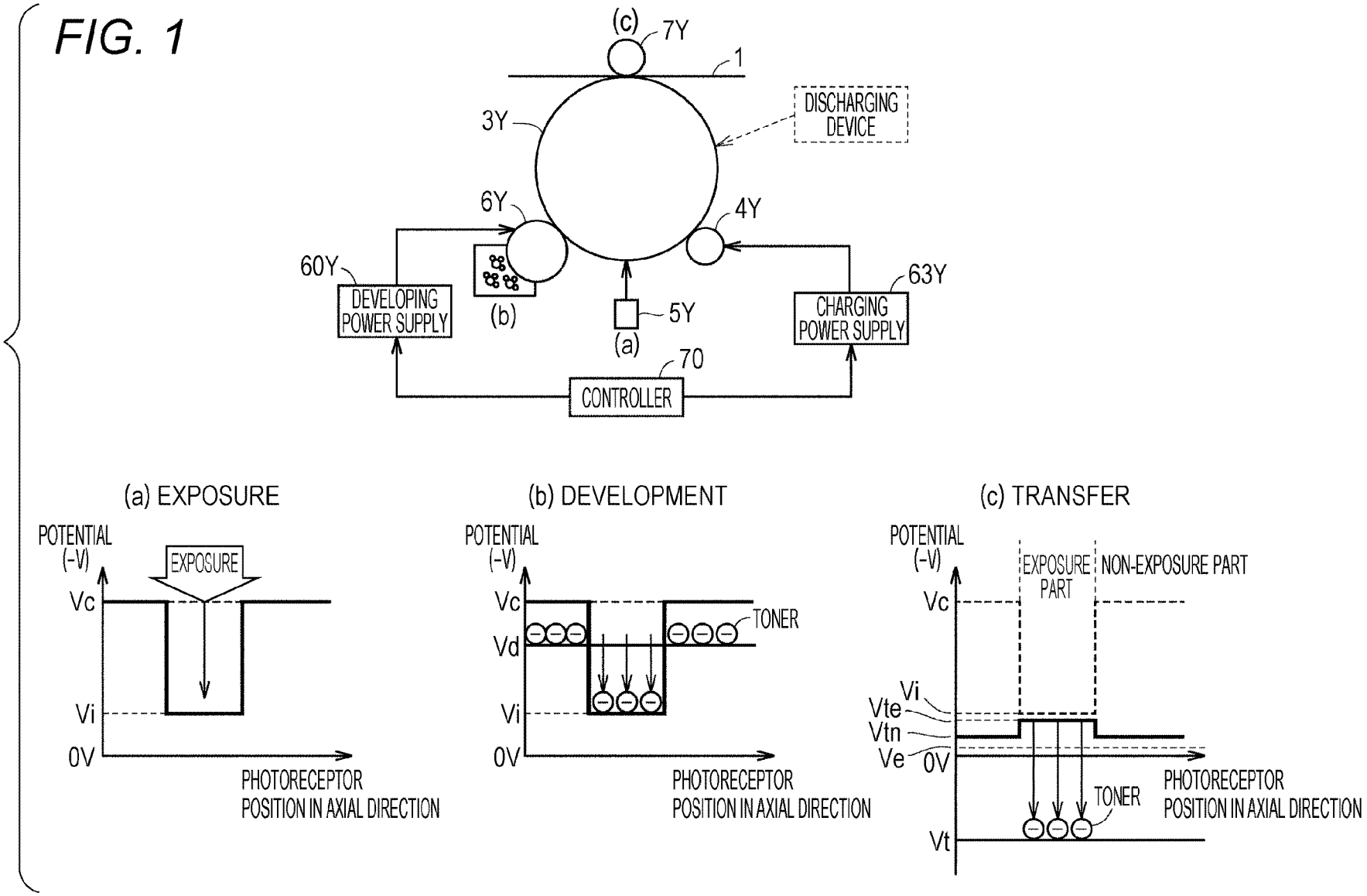
FIG. 1 is a diagram for explaining a surface potential of a photoreceptor in each image forming process of an electrographic image forming apparatus.

Hereinafter, one or more embodiments of the present invention will be described in detail with reference to the drawings. However, the scope of the invention is not limited to the disclosed embodiments. In the following description, the same components are respectively denoted with the same reference numerals. The same components have the same name and function. Therefore, detailed description thereof will not be repeated. Each embodiment and each modification described below may be selectively combined as appropriate.

[Technical Idea]

FIG. 1 is a diagram for explaining a surface potential of a photoreceptor in each image forming process of an electrographic image forming apparatus. First, the principle for causing an image memory will be described with reference to FIG. 1. An electrographic image forming apparatus includes a photoreceptor 3Y. Around the photoreceptor 3Y, a charging roller 4Y, an exposurer 5Y, a developing roller 6Y, an intermediate transfer belt 1, and a primary transfer roller 7Y are arranged.

The photoreceptor 3Y is rotatable and functions as an image carrier for carrying and conveying a yellow (Y) toner image. The charging roller 4Y is arranged in contact with or close to the photoreceptor 3Y and charges the photoreceptor 3Y by application of a charging bias Vcb by a charging power supply 63Y. As a result, the surface potential of the photoreceptor 3Y is uniformly a charging potential Vc (state (a)).

The exposurer 5Y forms a latent image by irradiating the charged surface of the photoreceptor 3Y with light. With this irradiation, a potential of an exposure part of the photoreceptor 3Y on which the latent image is formed approaches a ground potential and becomes an exposure potential Vi (state (a)).

The developing roller 6Y is arranged close to the photoreceptor 3Y, and a developing power supply 60Y applies a developing bias Vd to the developing roller 6Y. The developing bias Vd is set between the charging potential Vc and the exposure potential Vi. With this setting, toner is supplied to the latent image according to a potential difference between the developing bias Vd and the exposure potential Vi. As a result, the latent image formed on the photoreceptor 3Y is developed (state (b)).

Next, the primary transfer roller 7Y applies a positive transfer bias Vt to the photoreceptor 3Y via the intermediate transfer belt 1. With this applied bias, the toner image on the photoreceptor 3Y is transferred on the intermediate transfer belt 1. At the time of this transfer, a current hardly flows in a part (exposure part) of the photoreceptor 3Y where the toner is attached, and a current easily flows in a part (non-exposure part) where the toner is not attached. Therefore, a potential difference between the charging potential Vc and the non-exposure transfer potential Vtn before and after the transfer in the non-exposure part is larger than the potential difference between the exposure potential Vi and the exposure transfer potential Vte before and after the transfer in the exposure part (state (c)).

As illustrated in the state (c) in FIG. 1, in a case where the exposure transfer potential Vte is not equal to the non-exposure transfer potential Vtn, the surface potential of the photoreceptor 3Y is not uniform. This phenomenon is referred to as an image memory (also called as a memory effect). In this case, at the time of next image forming cycle, the non-uniformity of the surface potential of the photoreceptor 3Y is reflected, and the density of the toner image formed on the photoreceptor 3Y is uneven. As a result, unevenness of the image occurs.

As a method of preventing the image memory, a configuration is known in which the surface potential of the photoreceptor 3Y on which the primary transfer has been performed is uniformly set to a discharging potential Ve by a discharging device. However, in response to a request for reducing cost in recent years, image forming apparatuses which do not have a discharging device increase. Therefore, a configuration for preventing the image memory in the image forming apparatus which does not have the discharging device will be described below with reference to FIGS. 2A and 2B.

Figure 2A:
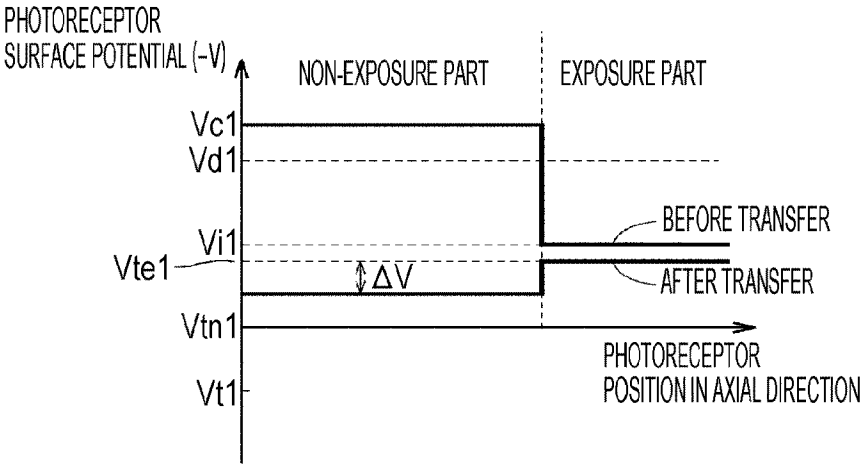
FIGS. 2A and 2B are diagrams for explaining a technical idea according to an embodiment.
Figure 2B:
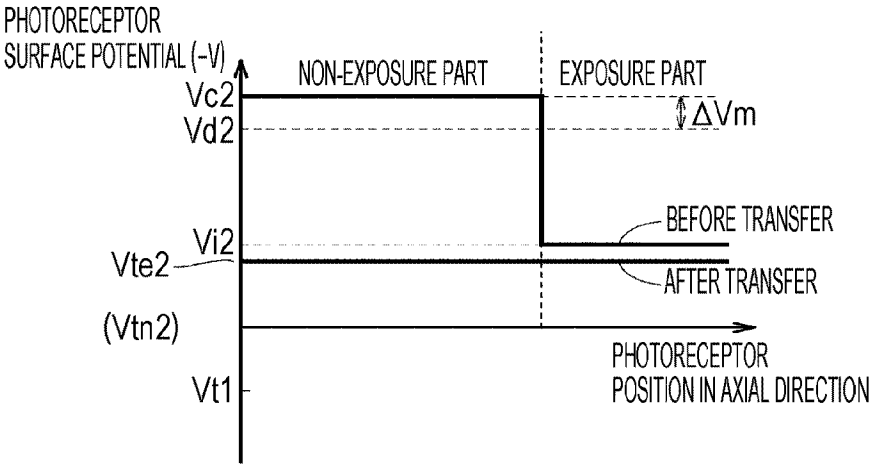

FIGS. 2A and 2B are diagrams for explaining a technical idea according to an embodiment. The image forming apparatus according to the embodiment makes the exposure transfer potential Vte be equal to the non-exposure transfer potential Vtn by controlling the charging potential Vc so as to prevent the image memory.

The image forming apparatus sets the transfer bias Vt to optimize a primary transfer efficiency of the primary transfer roller 7Y. More specifically, the image forming apparatus uses a voltage which is obtained when a predetermined current is flowed to the primary transfer roller 7Y (referred to as ATVC voltage) as a resistance value of the primary transfer roller 7Y, and sets the transfer bias Vt to be applied to the primary transfer roller 7Y based on the ATVC voltage.

In a condition (A), it is assumed that a transfer bias Vt1, a charging potential Vc1, a developing bias Vd1, and an exposure potential Vi1 be set. In the condition (A), it is assumed that the potential of the non-exposure part on which the primary transfer has been performed be a non-exposure transfer potential Vtn1 and the potential of the exposure part be an exposure transfer potential Vte1.

The image forming apparatus according to the embodiment obtains the non-exposure transfer potential Vtn1 and the exposure transfer potential Vte1 and calculates a potential difference ΔV between the exposure part and the non-exposure part after transfer. The image forming apparatus calculates a correction amount of the charging potential based on the potential difference ΔV and calculates a charging potential Vc2 obtained by integrating the charging potential Vc1 and the correction amount. Specifically, the image forming apparatus calculates the correction amount (charging potential Vc2) so that a fluctuation of the potential difference of the non-exposure part before and after the transfer caused by a change from the charging potential Vc1 to Vc2 and a fluctuation of the potential difference of the exposure part before and after the transfer is the potential difference ΔV as calculated above. A method of calculating the correction amount will be described later. The image forming apparatus determines the charging bias Vcb necessary for the surface potential of the photoreceptor 3Y to be the calculated charging potential Vc2.

In a condition (B), the image forming apparatus sets the transfer bias to Vt1 which is the same as that in the condition (A) and sets the charging potential to the calculated Vc2. With this setting, the non-exposure transfer potential Vtn2 and the exposure transfer potential Vte2 after the primary transfer are equal to each other. As a result, the image forming apparatus according to the embodiment can prevent the image memory without having the discharging device.

Furthermore, if only the charging potential Vc is changed, the potential difference between the charging potential Vc and the developing bias Vd (referred to as "margin potential ΔVm" below) is changed. If the margin potential ΔVm is too large, a problem occurs in that a carrier is attached to the photoreceptor 3Y. On the other hand, if the margin potential ΔVm is too small, a problem occurs in that the toner attaches to the non-exposure part of the photoreceptor 3Y. Therefore, the image forming apparatus according to the embodiment determines a developing bias Vd2 so as to maintain the margin potential ΔVm constant. More specifically, the developing bias Vd2 is calculated by adding a value obtained by subtracting the charging potential Vc1 from the charging potential Vc2 to the developing bias Vd1. With this configuration, the image forming apparatus can prevent a disadvantage caused by control to prevent the image memory.

Furthermore, when the developing bias Vd is changed, a developing efficiency is changed. The larger the potential difference between the developing bias Vd and the exposure potential Vi is, the more the toner amount to be supplied to the latent image per unit is. Therefore, the image forming apparatus according to the embodiment changes an exposure condition according to the potential difference between the developing bias Vd and the exposure potential Vi. For example, the image forming apparatus changes an exposure area per unit area or an exposure output. The image forming apparatus changes the exposure condition so that an apparent image density (toner amount to be supplied to one pixel) is maintained before and after the change of the developing bias Vd. With this configuration, the image forming apparatus can prevent a disadvantage caused by control to prevent the image memory. A more specific configuration and processing will be described below.

[Embodiment]

(Image Forming Apparatus 300)

Figure 3:
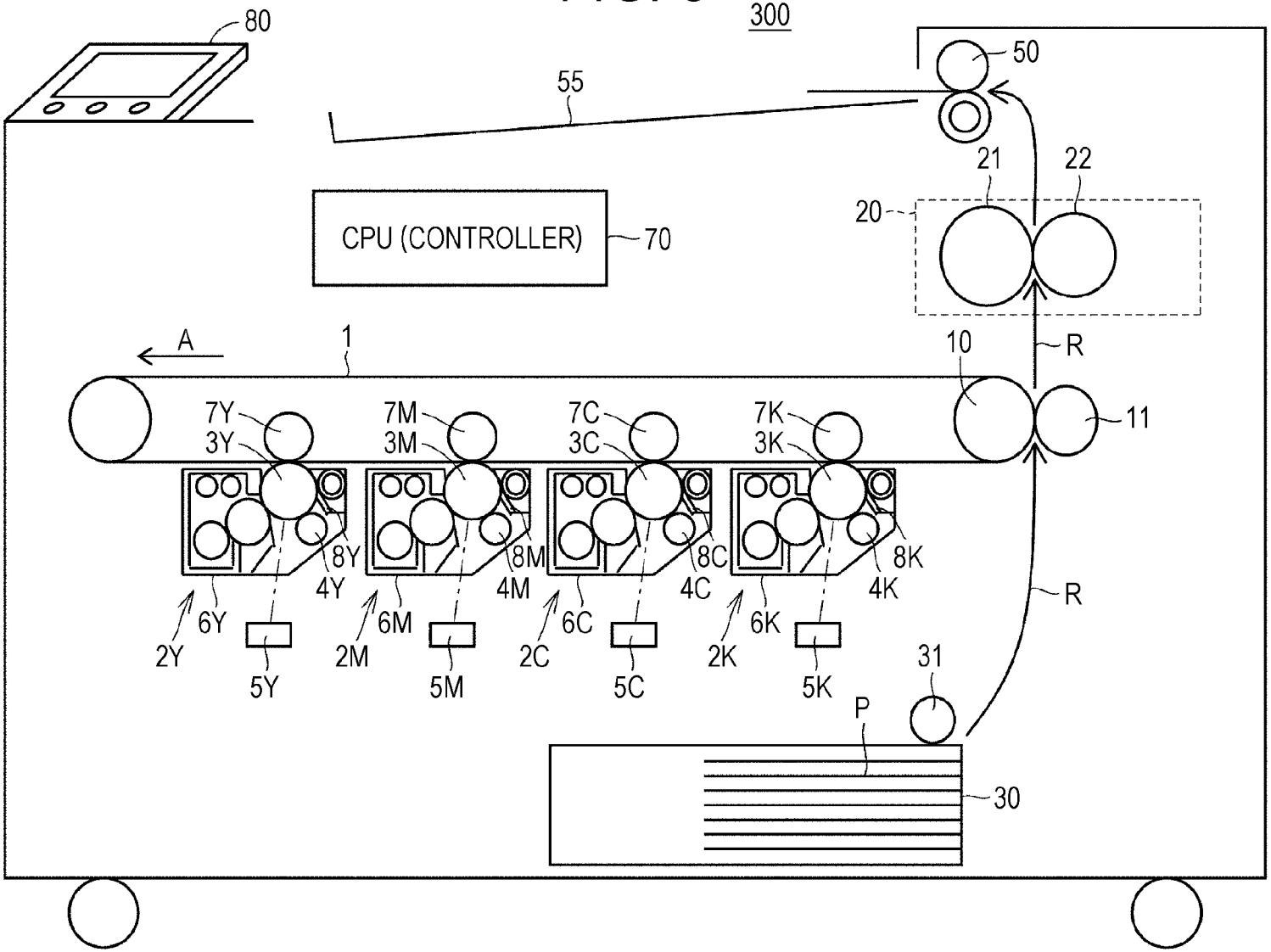
FIG. 3 is a diagram for explaining an exemplary configuration of an image forming apparatus according to an embodiment.

FIG. 3 is a diagram for explaining an exemplary configuration of an image forming apparatus 300 according to an embodiment. In one embodiment, the image forming apparatus 300 is an electrographic image forming apparatus such as a laser printer and an LED printer. As illustrated in FIG. 3, the image forming apparatus 300 includes the intermediate transfer belt 1 in a substantially center as a belt member. Under a lower horizontal part of the intermediate transfer belt 1, four image forming units 2Y, 2M, 2C, and 2K respectively corresponding to yellow (Y), magenta (M), cyan (C), and black (K) are arranged along the intermediate transfer belt 1. The image forming units 2Y, 2M, 2C, and 2K respectively include photoreceptors 3Y, 3M, 3C, and 3K which can hold the toner image.

Around the respective photoreceptors 3Y, 3M, 3C, and 3K which are image carriers, along the rotation direction in the following order, charging rollers 4Y, 4M, 4C, and 4K for charging the corresponding photoreceptors, exposurers 5Y, 5M, 5C, and 5K, developing rollers 6Y, 6M, 6C, and 6K, primary transfer rollers 7Y, 7M, 7C, and 7K respectively facing to the photoreceptors 3Y, 3M, 3C, and 3K having the intermediate transfer belt 1 therebetween, and cleaning blades 8Y, 8M, 8C, and 8K are arranged. In another aspect, a non-contact charging device (for example, charging device according to corona discharge method) may be arranged instead of the charging rollers 4Y, 4M, 4C, and 4K.

A part of the intermediate transfer belt 1 supported by an intermediate transfer belt driving roller 10 has pressure contact with a secondary transfer roller 11, and secondary transfer is performed on the region. A fixing and heating unit 20 including a fixing roller 21 and a pressure roller 22 is arranged at a downstream position of a conveyance path R behind the secondary transfer region.

A sheet feeding cassette 30 is removably arranged in a lower part of the image forming apparatus 300. Paper sheets P stacked and housed in the sheet feeding cassette 30 are fed to the conveyance path R one by one from the uppermost sheet by rotation of a sheet feeding roller 31.

An operation panel 80 is arranged in an upper part of the image forming apparatus 300. The operation panel 80 includes, for example, a screen in which a touch panel and a display are stacked and a physical button.

In the above example, the image forming apparatus 300 employs a tandem-type intermediate transfer method. However, the method is not limited to this. Specifically, the image forming apparatus may employ a cycle method and a direct transfer method in which a developing device directly transfers toner to a printed medium.

(Outline Operation of Image Forming Apparatus 300)

Next, an outline operation of the image forming apparatus 300 having the above configuration will be described. When an external device (for example, personal computer) inputs an image signal to a central processing unit (CPU) 70 which functions as a controller of the image forming apparatus 300, the CPU 70 color-converts the image signal into digital image signals of yellow, cyan, magenta, and black and performs exposure by making the exposurers 5Y, 5M, 5C, and 5K of the respective image forming units 2Y, 2M, 2C, and 2K emit light based on the input digital signal.

With this processing, electrostatic latent images formed on the photoreceptors 3Y, 3M, 3C, and 3K are respectively developed by the developing rollers 6Y, 6M, 6C, and 6K and turn to be toner images of respective colors. The toner images of the respective colors are sequentially superimposed and primarily transferred on the intermediate transfer belt 1 which moves along a direction of the arrow A in FIG. 1 by actions of the primary transfer rollers 7Y, 7M, 7C, and 7K.

The toner image formed on the intermediate transfer belt 1 in this way is collectively and secondarily transferred on the paper sheet P by an action of the secondary transfer roller 11.

The toner image which has been secondarily transferred on the paper sheet P reaches the fixing and heating unit 20. The toner image is fixed on the paper sheet P by actions of the heated fixing roller 21 and the pressure roller 22. The paper sheet P on which the toner image has been fixed is discharged to a sheet discharge tray 55 via a sheet discharge roller 50.

(Electrical Configuration)

Figure 4:
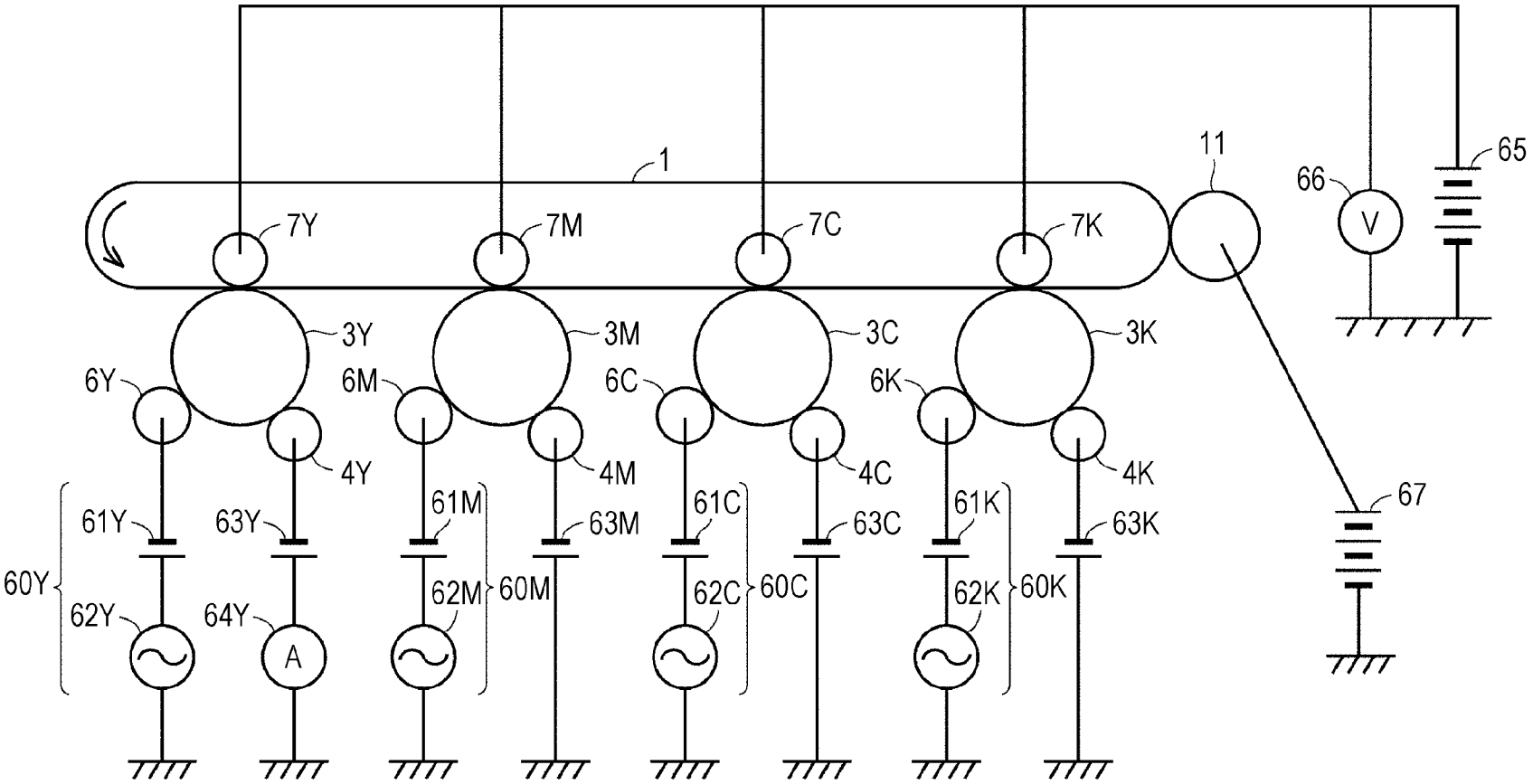
FIG. 4 is a diagram for explaining a specific structure around an intermediate transfer belt.
Figure 5:
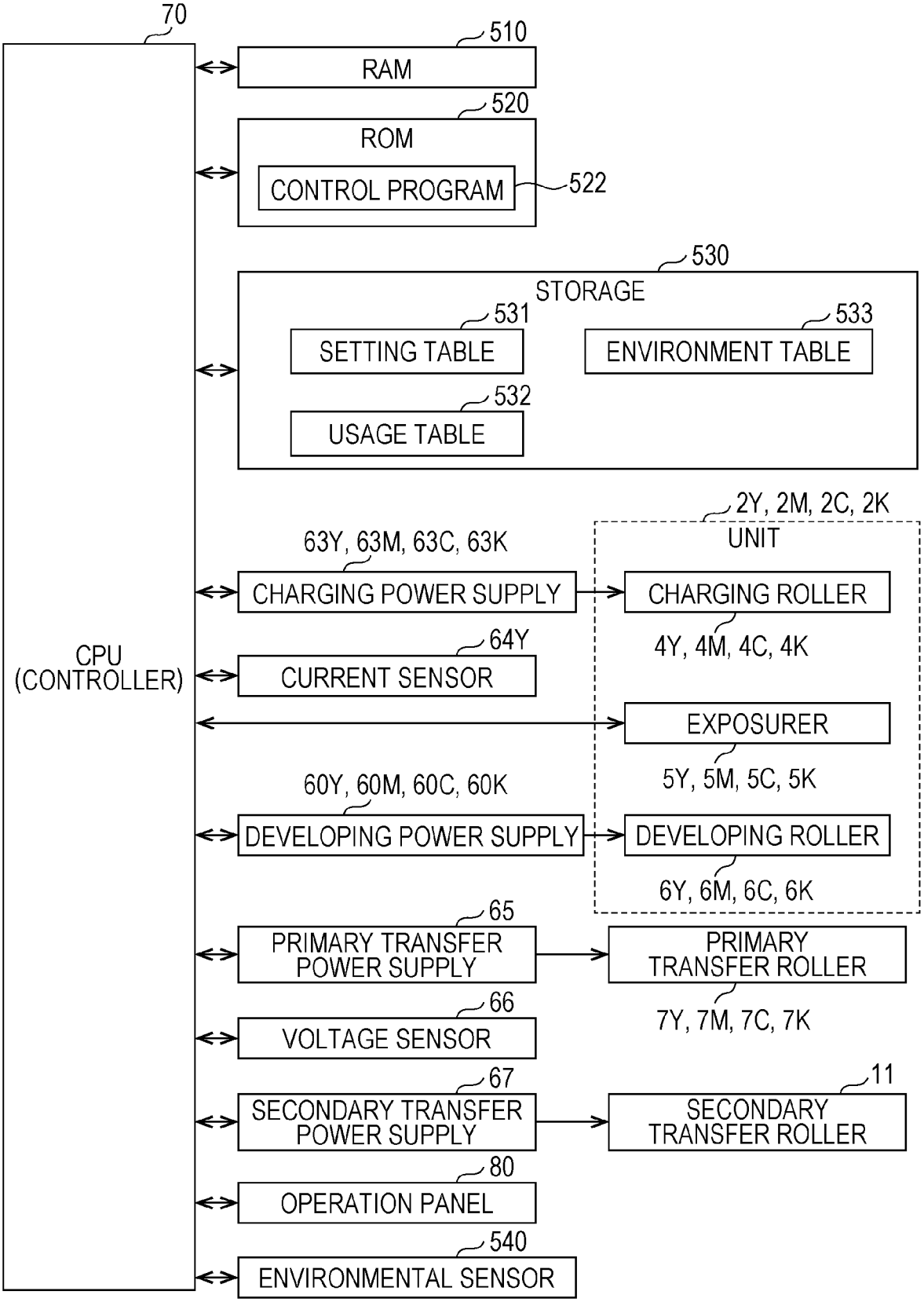
FIG. 5 is a diagram for explaining various devices connected to a CPU.

Next, an electrical configuration connected to the CPU 70 will be described with reference to FIGS. 4 and 5. FIG. 4 is a diagram for more specifically explaining a structure around the intermediate transfer belt 1. FIG. 5 is a diagram for explaining various devices connected to the CPU 70.

Charging power supplies 63Y, 63M, 63C, and 63K are respectively connected to the charging rollers 4Y, 4M, 4C, and 4K as in FIGS. 4 and 5. A current sensor 64Y is arranged between the charging power supply 63Y and a ground potential.

Developing power supplies 60Y, 60M, 60C, and 60K are respectively connected to the developing rollers 6Y, 6M, 6C, and 6K. The developing power supplies 60Y, 60M, 60C, and 60K respectively include DC power supplies 61Y, 61M, 61C, and 61K and AC power supplies 62Y, 62M, 62C, and 62K. That is, a voltage obtained by superimposing a DC voltage and an AC voltage is applied to each of the developing rollers 6Y, 6M, 6C, and 6K.

A common primary transfer power supply 65 is connected to the primary transfer rollers 7Y, 7M, 7C, and 7K. That is, a common transfer bias Vt is applied to each of the primary transfer rollers 7Y, 7M, 7C, and 7K. A voltage sensor 66 is arranged between the primary transfer power supply 65 and the ground potential. In another aspect, the image forming apparatus 300 may include an independent primary transfer power supply for each of the primary transfer rollers 7Y, 7M, 7C, and 7K.

A secondary transfer power supply 67 is connected to the secondary transfer roller 11.

The CPU 70 is connected to various power supplies (charging power supplies 63Y, 63M, 63C, and 63K, developing power supplies 60Y, 60M, 60C, and 60K, primary transfer power supply 65, and secondary transfer power supply 67) and various sensors (current sensor 64Y and voltage sensor 66). The CPU 70 transmits a control signal to each of the various power supplies and controls the outputs of various power supplies. Furthermore, various sensors transmit measurement results to the CPU 70.

In addition to the above devices, the CPU 70 is electrically connected to a Random Access Memory (RAM) 510, a Read Only Memory (ROM) 520, a storage 530, the operation panel 80, and an environmental sensor 540.

The RAM 510 is realized by, for example, a Dynamic Random Access Memory (DRAM). The RAM 510 may function as a working memory for temporarily storing data and image data required to execute a control program 522 stored in the ROM 520 by the CPU 70.

The storage 530 is realized by, for example, a hard disk drive. The storage 530 stores a setting table 531, a usage table 532, and an environment table 533.

The setting table 531 stores various image forming conditions such as a rotation speed of each of the photoreceptors 3Y, 3M, 3C, and 3K, the charging potential Vc, the charging bias Vcb, the developing bias Vd, and the transfer bias Vt. The usage table 532 stores usages of the photoreceptors 3Y, 3M, 3C, and 3K. As an example, the usage of the photoreceptor 3Y is set to any one of the number of total printed sheets printed by the photoreceptor 3Y, the number of rotations of the photoreceptor 3Y, and a travel distance of the photoreceptor 3Y. The CPU 70 updates the usage of the photoreceptor 3Y every time when printing is performed by using the photoreceptor 3Y. Details of the environment table 533 will be described later.

The operation panel 80 outputs information indicating an operation content of a user (for example, coordinates in touch panel where user has touched) to the CPU 70. The environmental sensor 540 can measure at least one of temperature and humidity and outputs the measurement result to the CPU 70.

(Determination of Charging Bias)

Figure 6B:
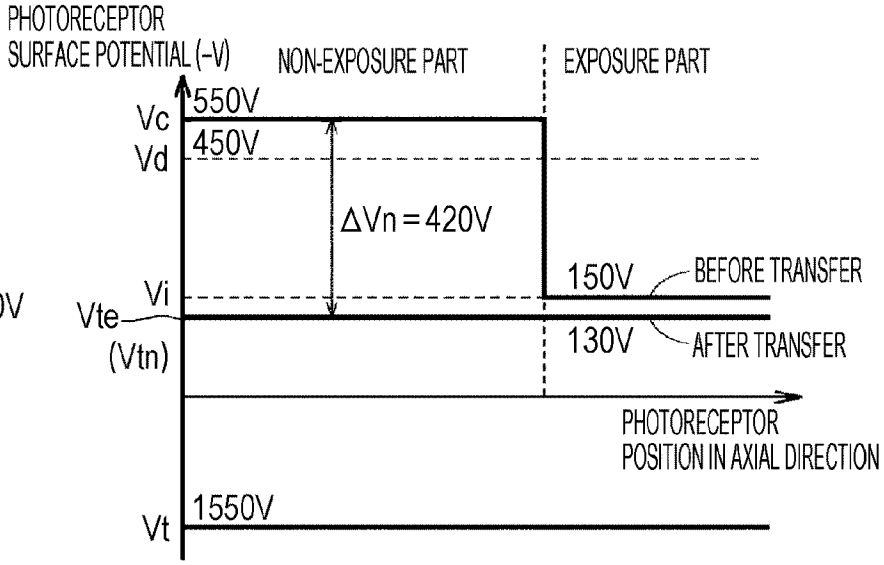
FIGS. 6A and 6B are diagrams for explaining processing for determining a charging bias.
Figure 6A:
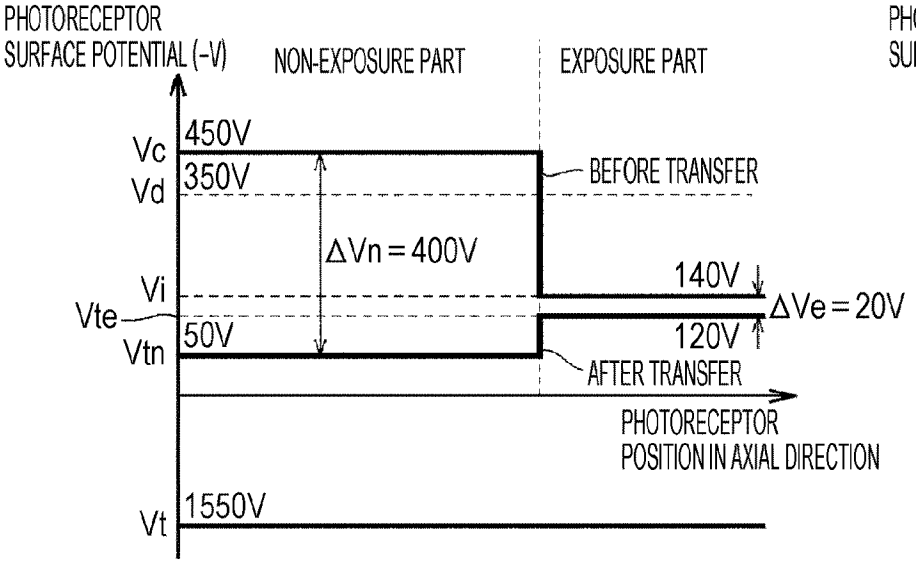

Next, a method of determining the charging potential Vc (charging bias Vcb) will be described with reference to FIGS. 6A and 6B. FIG. 6A is a diagram of the surface potential of the photoreceptor 3Y before control for preventing the image memory is performed. FIG. 6B is a diagram of the surface potential of the photoreceptor 3Y after control for preventing the image memory has been performed.

In one aspect, the CPU 70 determines the transfer bias Vt. More specifically, the voltage (ATVC voltage) to be applied to any one of the primary transfer rollers 7Y, 7M, 7C, and 7K at the time when a constant current flows from the primary transfer power supply 65 to any one of the primary transfer rollers is measured by the voltage sensor 66.

The CPU 70 determines the transfer bias Vt according to the measured ATVC voltage. In the example illustrated in FIGS. 6A and 6B, the CPU 70 determines the transfer bias Vt to 1550 V. In the example illustrated in FIG. 6A, the charging potential Vc is set to −450 V, the developing bias Vd is set to −350 V, and the exposure potential Vi is set to −140 V.

Under the above conditions, the CPU 70 calculates the exposure transfer potential Vte and the non-exposure transfer potential Vtn. The calculation method will be described with reference to FIGS. 7 to 10.

<Acquisition of Non-Exposure Transfer Potential Vtn>

Figure 7:
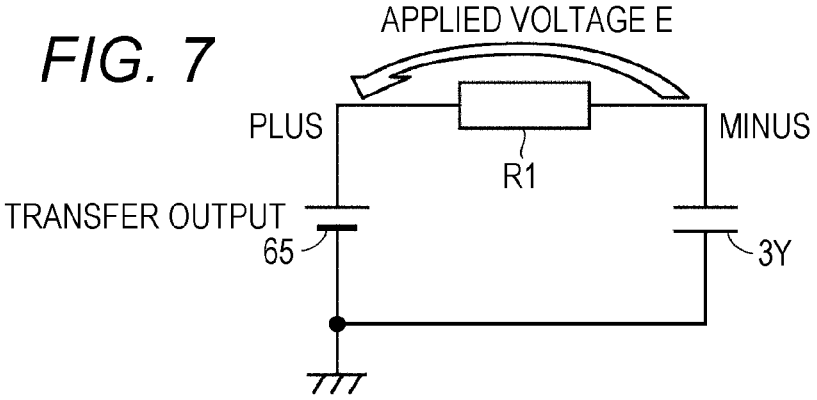
FIG. 7 is a diagram of a primary transfer circuit including a photoreceptor and a primary transfer roller.

FIG. 7 is a diagram of a primary transfer circuit including the photoreceptor 3Y and the primary transfer roller 7Y. In FIG. 7, an equivalent circuit of the photoreceptor 3Y is regarded as a capacitor. In this case, a potential difference ΔVn of the photoreceptor 3Y of the non-exposure part before and after transfer is expressed by the following expression (1).

[Expression 1]

$$\Delta Vn = \Delta Q \times C = \Delta Q \times (d/(\varepsilon \times S)) \quad (1)$$

The reference ΔQ indicates an amount of electric charges flowing into the photoreceptor 3Y by the primary transfer, the reference C indicates a capacitance of the photoreceptor 3Y (capacitor of equivalent circuit), the reference d indicates a film thickness of a photosensitive layer of the photoreceptor 3Y, the reference c indicates a permittivity, and the reference S indicates an area of the photosensitive layer of the photoreceptor 3Y in the primary transfer circuit.

In the above description, since the permittivity ε and the area S are constants, if the amount of the electric charges ΔQ is constant, the potential difference ΔVn depends on the film thickness d.

More specifically, the potential difference ΔVn depends on time tin which the transfer bias Vt is applied to a predetermined position of the photoreceptor 3Y along the rotation direction from the primary transfer roller 7Y via the intermediate transfer belt 1. In other words, the time t is time in which the predetermined position of the photoreceptor 3Y along the rotation direction has contact with the intermediate transfer belt 1 in the primary transfer.

Figure 8:
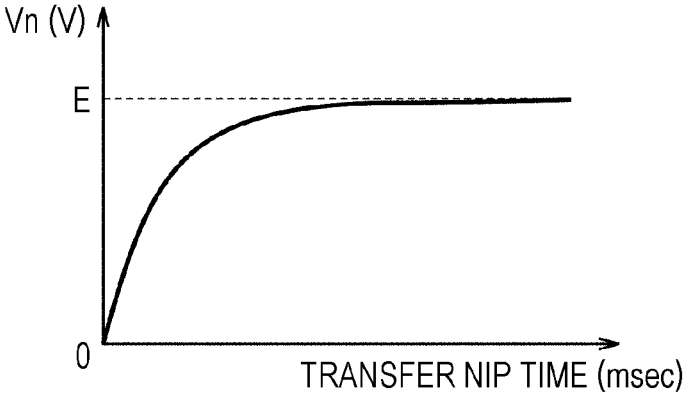
FIG. 8 is a diagram of time dependency of a potential difference of a non-exposure part of the photoreceptor before and after transfer.

FIG. 8 is a diagram of dependency of the potential difference ΔVn on the time t. As illustrated in FIG. 8, the potential difference ΔVn approaches an applied voltage E as the time t elapses. The applied voltage E is a voltage to be applied to a resistance R1 when it is assumed that a resistance in a path through which the transfer bias Vt is applied including the primary transfer roller 7Y and the intermediate transfer belt 1 in FIG. 7 be R1. The applied voltage E is a value obtained by integrating the absolute value of the transfer bias Vt and the absolute value of the surface potential of the photoreceptor 3Y (that is, charging potential Vc).

The potential difference ΔVn(t) at a certain time T can be expressed by the following expression (2).

[Expression 2]

$$\Delta V_n(t) = E\left(1 - e^{-\frac{1}{R1 \cdot C} t}\right) \quad (2)$$

The time t is calculated from the rotation speed of the photoreceptor 3Y. The resistance R1 is calculated from the ATVC voltage. The applied voltage E is calculated from the transfer bias Vt and the exposure potential Vi. Therefore, the CPU 70 can calculate the potential difference ΔVn if the film thickness d is known.

Figure 9:
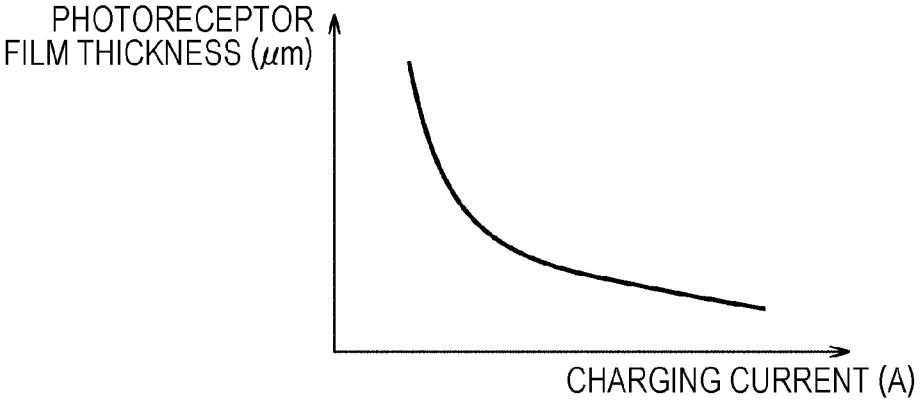
FIG. 9 illustrates relationship between a charging current and a film thickness.

FIG. 9 illustrates relationship between a charging current Ic and the film thickness d. A technique for estimating the film thickness of the photoreceptor from the charging current is known. The CPU 70 according to the embodiment estimates the film thickness d of the photoreceptor 3Y using the known technique. More specifically, the CPU 70 estimates the film thickness d from the magnitude of the charging current detected by the current sensor 64Y.

In another aspect, the CPU 70 may calculate the film thickness d based on the usage of the photoreceptor 3Y stored in the usage table 532.

Figure 10:
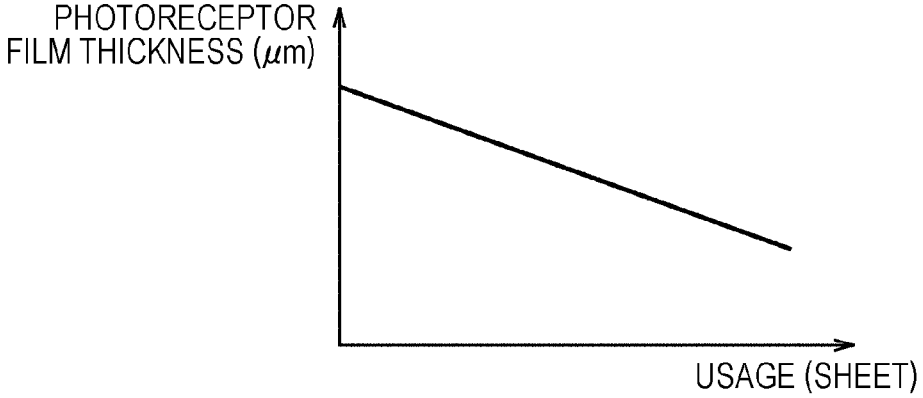
FIG. 10 illustrates relationship between an usage of the photoreceptor and the film thickness of the photoreceptor.

FIG. 10 illustrates relationship between the usage of the photoreceptor 3Y and the film thickness d of the photoreceptor 3Y. As illustrated in FIG. 10, since the surface of the photoreceptor 3Y is scraped by a cleaning blade 8Y as the usage of the photoreceptor 3Y increases, the film thickness d decreases. The usage of the photoreceptor 3Y is substantially proportional to the film thickness d. Therefore, in another aspect, the image forming apparatus 300 may be configured to store the proportional relationship (function or table) illustrated in FIG. 10 in the storage 530 and calculate the film thickness d of the photoreceptor 3Y based on the proportional relationship and the usage of the photoreceptor 3Y stored in the usage table 532.

The CPU 70 calculates the potential difference ΔVn according to the expression (2) using the calculated film thickness d. Referring again to FIG. 6A, the CPU 70 calculates the potential difference ΔVn as 400 V. The CPU 70 calculates the non-exposure transfer potential Vtn as −50 V by integrating the charging potential Vc (−450 V) and the potential difference ΔVn (400 V).

Since the toner exists in the exposure part, the charge is less likely to move than in the non-exposure part. Therefore, the potential difference ΔVe of the exposure part of the photoreceptor 3Y before and after the transfer is calculated by multiplying a predetermined coefficient by the potential difference between the exposure potential Vi and the transfer bias Vt as an example. The predetermined coefficient depends on the time t when the predetermined position of the photoreceptor 3Y according to the rotation direction has contact with the intermediate transfer belt 1. The predetermined coefficient is stored in the storage 530. In the example illustrated in FIG. 6A, the CPU 70 calculates the potential difference ΔVe as 20 V. The CPU 70 calculates the exposure transfer potential Vte as −120 V by integrating the exposure potential Vi (−140 V) and the potential difference ΔVe (20 V).

According to the series of processing, the CPU 70 obtains the non-exposure transfer potential Vtn (−50 V) and the exposure transfer potential Vte (−120 V). As a result, the CPU 70 calculates the potential difference ΔV between the non-exposure transfer potential Vtn and the exposure transfer potential Vte as 70 V.

<Determination of Charging Bias>

Next, the CPU 70 determines a correction amount of the charging potential Vc according to the potential difference ΔV. Processing for determining the correction amount will be described with reference to FIGS. 11 and 12.

Figure 11:
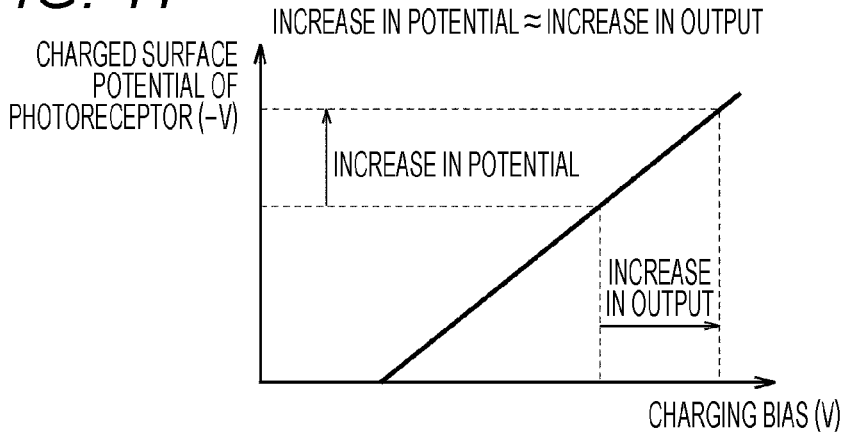
FIG. 11 illustrates relationship between a charging potential and the charging bias.

FIG. 11 illustrates relationship between the charging potential Vc and the charging bias Vcb. As illustrated in FIG. 11, the charging potential Vc is substantially proportional to the charging bias Vcb. More specifically, an increase rate of the charging potential Vc in a case where the charging bias Vcb increases by unit amount is "100%", and the increase in the charging bias Vcb is substantially the same as the increase in the charging potential Vc.

Figure 12:
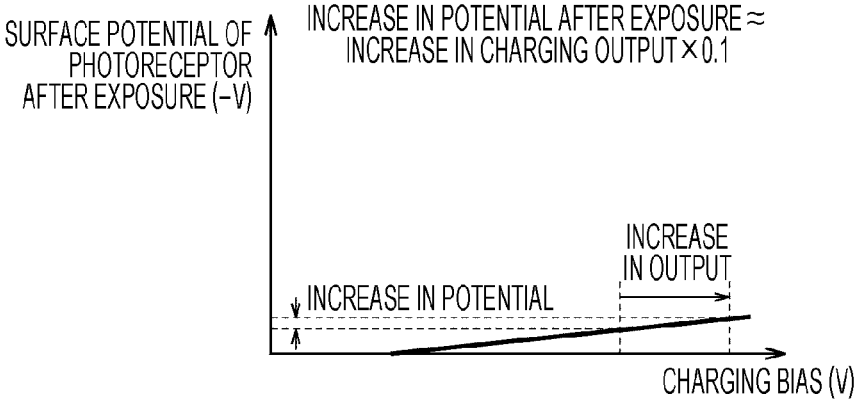
FIG. 12 illustrates relationship between an exposure potential and the charging bias.

FIG. 12 illustrates relationship between the exposure potential Vi and the charging bias Vcb. As illustrated in FIG. 12, the exposure potential Vi is substantially proportional to the charging bias Vcb. However, an increase rate of the exposure potential Vi in a case where the charging bias Vcb increases by unit amount is "10%".

By using the relationships illustrated in FIGS. 11 and 12 and the above expression (2), the CPU 70 determines a correction amount ΔVc of the charging potential Vc (that is, correction amount of charging bias Vcb) so that the potential difference ΔV between the non-exposure transfer potential Vtn and the exposure transfer potential Vte becomes zero. Under the condition illustrated in FIG. 6A, the CPU 70 calculates the correction amount ΔVc as 100 V.

Referring to FIG. 6B, the corrected charging potential Vc is 550 V (=450V+ΔVc). As a result, the applied voltage E in the expression (2) is changed from 2000 V (=450 V+1550 V) to 2100 V (=550 V+1550 V). That is, a variation rate of the applied voltage E is 5% (=(2100 V−2000 V)/2000 V). Therefore, the potential difference ΔVn increases by 5% and is changed from 400 V to 420 V. As a result, the non-exposure transfer potential Vtn is changed to −130 V (=−550 V+420 V).

Furthermore, as illustrated in FIG. 12, as an absolute value of the charging potential Vc increases by 100 V, an absolute value of the exposure potential Vi increases by 10 V (10% of correction amount ΔVc) and is changed from −140 V to −150 V. In addition, the potential difference ΔVe of the exposure part of the photoreceptor 3Y before and after the transfer is not substantially fluctuated, the exposure transfer potential Vte is changed from −120 V to −130 V (−150 V+ΔVe).

As a result, the non-exposure transfer potential Vtn and the exposure transfer potential Vte become the same (−130 V).

According to the above, the image forming apparatus 300 according to the embodiment can calculate the correction amount ΔVc relative to the exposure potential Vi before correction so that the corrected potential difference ΔV becomes zero based on the potential difference ΔV between the non-exposure transfer potential Vtn and the exposure transfer potential Vte before the correction (that is, can determine corrected charging bias Vcb). As a result, the image forming apparatus 300 according to the embodiment can prevent the image memory.

As illustrated in FIG. 4, in a case where the primary transfer rollers 7Y 7M, 7C, and 7K share the common primary transfer power supply 65, the image forming apparatus 300 cannot set an optimum transfer bias Vt for each of the photoreceptors 3Y, 3M, 3C, and 3K. In such a case, the image forming apparatus 300 according to the embodiment can prevent the image memory by applying the optimum charging bias Vcb to each of the photoreceptors 3Y, 3M, 3C, and 3K.

The image forming apparatus 300 can prevent the image memory by controlling the charging power supplies 63Y, 63M, 63C, and 63K in the next image forming cycle and applying different charging biases Vcb to the respective charging rollers 4Y, 4M, 4C, and 4K without having the discharging device, in other words, without discharging a potential of the photoreceptor after the toner image has been transferred on the intermediate transfer belt 1.

In addition, in recent years, reduction in cost of the image forming apparatus has been strongly desired, and manufacturing accuracy of a device included in the image forming apparatus including the intermediate transfer belt 1 and the primary transfer rollers 7Y, 7M, 7C, and 7K tends to be low. In this case, variation in the resistance R1 in a circuit to which the transfer bias Vt is applied increases. Even in such a case, the image forming apparatus 300 according to the embodiment can prevent the image memory by applying the different charging biases Vcb to the charging rollers 4Y, 4M, 4C, and 4K.

Furthermore, the CPU 70 changes the developing bias Vd of each of the DC power supplies 61Y, 61M, 61C, and 61K respectively included in the developing power supplies 60Y, 60M, 60C, and 60K according to the change in the charging potential Vc of each of the charging power supplies 63Y, 63M, 63C, and 63K so as to maintain the margin potential ΔVm (potential difference between charging potential Vc and developing bias Vd) to be constant. In this way, the CPU 70 sets the charging bias Vcb and the developing bias Vd for each of the image forming units 2Y, 2M, 2C, and 2K. In the above example, the CPU 70 changes the developing bias Vd of the DC power supply 61Y from 350 V to 450 V (=350 V+ΔVc).

According to the above, the image forming apparatus 300 according to the embodiment can prevent adhesion of the carrier and the adhesion of the toner to the non-exposure part by changing the margin potential ΔVm according to the change in the charging potential Vc.

Furthermore, the CPU 70 changes the exposure condition of the exposurer 5Y according to the change in the developing bias Vd of the developing power supply 60Y. In the example illustrated in FIG. 6B, the potential difference between the developing bias Vd and the exposure potential Vi is larger than that in the state in FIG. 6A. Therefore, the CPU 70 makes the exposure area per unit area of the exposurer 5Y smaller than that in the state in FIG. 6A. As a result, the CPU 70 keeps an apparent image density (toner amount supplied to one pixel) before and after the change in the developing bias Vd.

(Control Structure)

Figure 13:
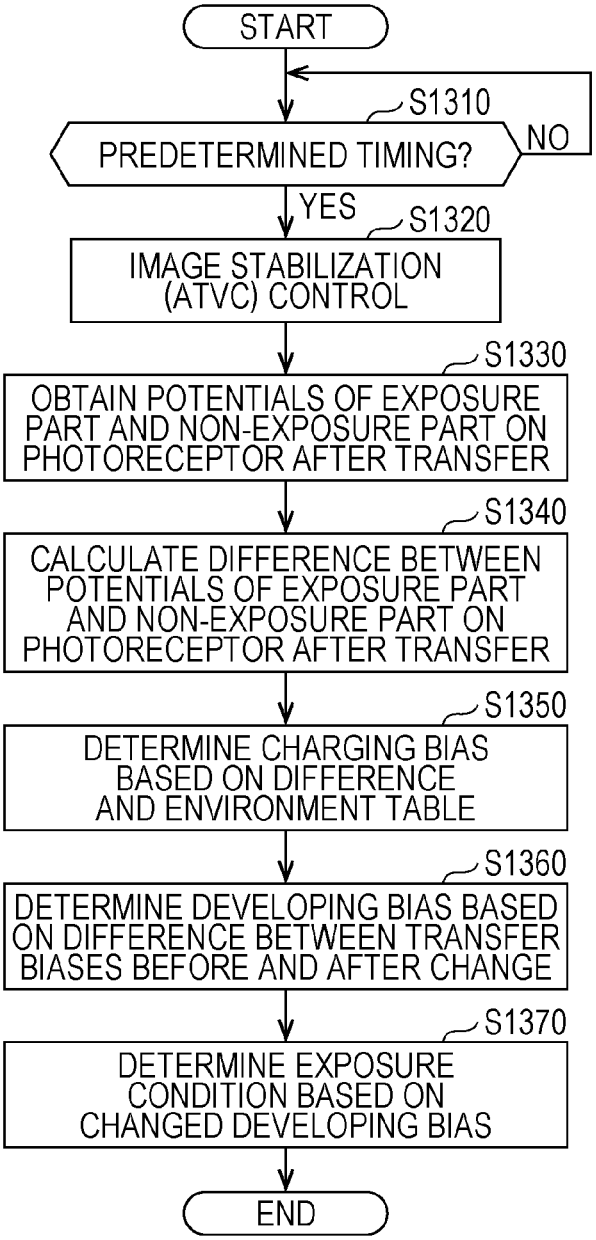
FIG. 13 is a flowchart of processing for determining an image forming condition based on a potential difference between a non-exposure transfer potential and an exposure transfer potential.

FIG. 13 is a flowchart of processing for determining an image forming condition based on the potential difference ΔV between the non-exposure transfer potential Vtn and the exposure transfer potential Vte. Each processing illustrated in FIG. 13 can be realized by executing the control program 522 by the CPU 70.

In step S1310, the CPU 70 determines whether it is a predetermined timing. The predetermined timing may include, for example, a timing when the image forming apparatus 300 turns on, a timing when each usage stored in the usage table 532 reaches a predetermined amount (for example, 1000 sheets), and the like. When determining that it is the predetermined timing, the CPU 70 performs processing in step S1320.

In step S1320, the CPU 70 determines the transfer bias Vt to stabilize the toner image formed on the intermediate transfer belt 1. As an example, the CPU 70 determines the transfer bias Vt based on a magnitude of the voltage (ATVC voltage), measured by the voltage sensor 66, applied to the primary transfer roller when a predetermined current is flowed to the primary transfer roller.

As another example, the CPU 70 may determine the transfer bias Vt so as to secure a minimum current required for movement of the toner from the photoreceptor to the intermediate transfer belt 1. The minimum current required for the movement of the toner (that is, movement amount of charge (μC/s)) is a value obtained by multiplying a toner charge amount (μC/g), an attachment amount of the toner image formed on the photoreceptor per unit area (g/m^2), a rotation speed of the photoreceptor (m/s), and a length of the toner image formed on the photoreceptor in the axial direction (m). Therefore, the CPU 70 may determine the transfer bias Vt based on the parameters determined from print conditions (image density, sheet size, and the like).

In step S1330, the CPU 70 obtains the non-exposure transfer potential Vtn and the exposure transfer potential Vte based on the determined transfer bias Vt, the charging potential Vc (charging bias Vcb) stored in the setting table 531 (before correction), the exposure potential Vi, and the developing bias Vd.

In step S1340, the CPU 70 calculates the potential difference ΔV between the non-exposure transfer potential Vtn and the exposure transfer potential Vte which have been obtained.

In step S1350, the CPU 70 calculates the correction amount ΔVc to correct the charging potential Vc used in step S1330 based on the calculated potential difference ΔV. More specifically, the CPU 70 calculates the correction amount ΔVc based on the calculated potential difference ΔV and the environment table 533.

In the above example, in FIG. 12, description that an increase rate of the exposure potential Vi in a case where the charging bias Vcb increases by unit amount is about 10% has been made. However, the exposure potential Vi changes depending on the environment (temperature and humidity). That is, the increase rate of the exposure potential Vi changes depending on the environment. The environment table 533 holds a plurality of environmental conditions (at least one of temperature and humidity) and a plurality of increase rates of the exposure potential Vi in association with each other. The CPU 70 specifies the increase rate of the exposure potential Vi corresponding to the measurement result by the environmental sensor 540 with reference to the environment table 533 and calculates the correction amount ΔVc based on the specified increase rate and the calculated potential difference ΔV.

The CPU 70 corrects the charging potential Vc stored in the setting table 531 based on the calculated correction amount ΔVc. In other words, the CPU 70 can determine the charging bias Vcb necessary for obtaining the corrected charging potential Vc. With this configuration, the image forming apparatus 300 according to the embodiment can determine the charging bias Vcb to make the non-exposure transfer potential Vtn and the exposure transfer potential Vte be the same regardless of the environment.

In step S1360, the CPU 70 corrects the developing bias Vd stored in the setting table 531 based on the calculated correction amount ΔVc. With this correction, the image forming apparatus 300 according to the embodiment can maintain the margin potential ΔVm before and after the change of the charging bias Vcd to be constant.

In step S1370, the CPU 70 changes the exposure condition stored in the setting table 531 based on the corrected developing bias Vd. More specifically, the CPU 70 changes the exposure condition so that an apparent image density (toner amount to be supplied to one pixel) is maintained before and after the change of the developing bias Vd.

The CPU 70 performs printing with the determined charging bias Vcb, the developing bias Vd, and under the exposure condition according to an input of a print job. In this case, since the potential difference ΔV between the non-exposure transfer potential Vtn and the exposure transfer potential Vte is controlled to be zero, unevenness in an output image caused by the image memory can be prevented.

(Selection of Mode)

In the above example, the image forming apparatus 300 according to the embodiment executes control for preventing the image memory at a predetermined timing. In another aspect, the image forming apparatus 300 can switch a high image quality mode and a normal mode, can perform control for preventing the image memory when the high image quality mode is set, and does not perform the control for preventing the image memory when the normal mode is set.

With this configuration, in a case where a user permits unevenness of the image caused by the image memory, the image forming apparatus 300 can improve productivity by omitting the control for preventing the image memory. Processing in the normal mode will be specifically described with reference to FIG. 14.

Figure 14:
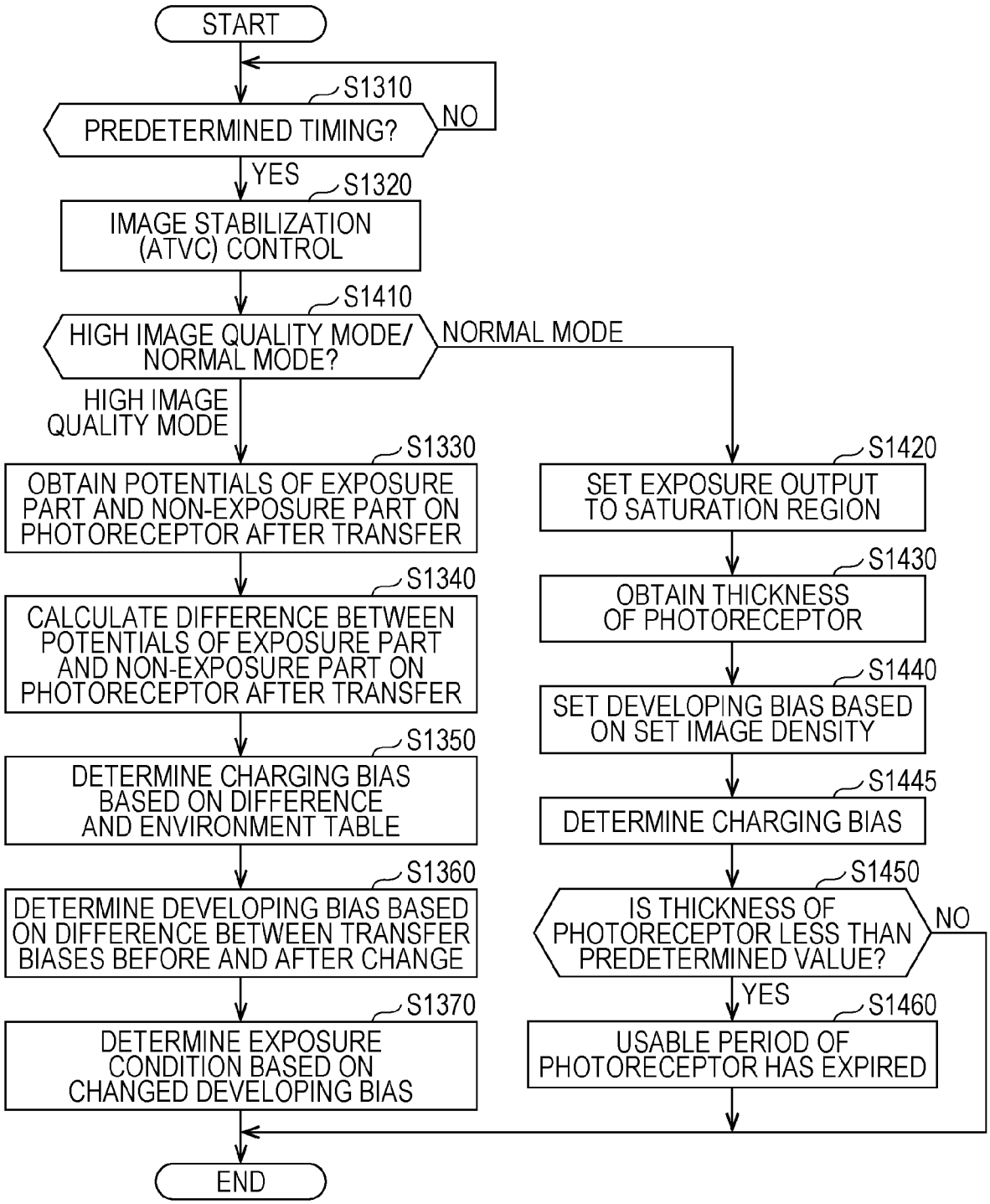
FIG. 14 is a flowchart for explaining processing in a high image quality mode and a normal mode.

FIG. 14 is a flowchart for explaining processing in the high image quality mode and the normal mode. The processing in the processing illustrated in FIG. 14 same as the processing in FIG. 13 is denoted with the same reference numeral. Therefore, the description of the processing will not be repeated.

In step S1410, the CPU 70 determines whether the mode is set to the high image quality mode or the normal mode. When determining that the high image quality mode is set, the CPU 70 performs processing in step S1330. On the other hand, when determining that the normal mode is set, the CPU 70 performs processing in step S1420. As an example, the user can select one of the above modes by operating the operation panel 80.

In step S1420, the CPU 70 sets an exposure output of the exposurer in the normal mode to a region where the exposure potential Vi does not substantially fluctuate relative to the fluctuation in the exposure output. The exposure potential Vi approaches a ground potential as the exposure output increases and converges a predetermined potential when the exposure output increases to a value equal to or more than a predetermined value. The region where the exposure potential Vi does not substantially fluctuate relative to the fluctuation of the exposure output indicates the exposure output equal to or more than the predetermined value. As a result, the image forming apparatus 300 can prevent unevenness in the image density in the normal mode.

In step S1430, the CPU 70 obtains the film thickness d of the photoreceptor. For example, the CPU 70 may calculate the film thickness d based on the charging current Ic measured by the current sensor 64Y and may calculate the film thickness d based on the usage of the photoreceptor stored in the usage table 532. In another aspect, the image forming apparatus 300 may include a measurement device for optically measuring the film thickness d.

In step S1440, in a case where a latent image is formed on the entire photoreceptor in the axial direction, the CPU 70 sets the developing bias Vd in the normal mode to a potential necessary for supplying an amount of toner corresponding to the predetermined image density to the latent image. More specifically, the CPU 70 determines the developing bias Vd based on the exposure potential Vi, the toner amount, and the film thickness d of the photoreceptor.

In step S1445, the CPU 70 determines the charging potential Vc based on the determined developing bias Vd so that the margin potential ΔVm becomes constant. The CPU 70 determines the charging bias Vcb so as to be the determined charging potential Vc. The CPU 70 stores the image forming conditions determined in steps S1420 to S1445 to the setting table 531 as image forming conditions in the normal mode. The CPU 70 stores the image forming conditions determined in steps S1330 to S1370 to the setting table 531 as image forming conditions in the high image quality mode.

In step S1450, the CPU 70 determines whether the obtained film thickness d of the photoreceptor is less than a predetermined value. When determining that the film thickness d is less than the predetermined value (YES in step S1450), the CPU 70 determines that a usable period of the photoreceptor has expired (step S1460). For example, the CPU 70 notifies that the usable period of the photoreceptor has expired on the operation panel 80. On the other hand, when determining that the film thickness d is equal to or more than the predetermined value (NO in step S1450), the CPU 70 terminates the series of processing.

According to the above, the CPU 70 can determine the optimum image forming condition in the normal mode. In the high image quality mode, the image forming conditions are determined in order of the charging bias Vcb, the developing bias Vd, and the exposure condition. However, in the normal mode, the image forming conditions are determined in order of the exposure condition, the developing bias Vd, and the charging bias Vcb.

As the absolute value of the charging bias Vcb increases, a wear amount of the film thickness d of the photoreceptor per unit time increases. Therefore, the image forming apparatus 300 according to the embodiment can prevent the usable period of the photoreceptor from being shortened by not largely correcting the charging bias Vcb in the normal mode.

[Other Configuration]

(Control Based on Image Information)

In a case where an image which has been printed immediately before is uniform, the image memory hardly occurs at the time of printing. This is because all the surface potentials of the transferred photoreceptor are substantially the exposure transfer potentials Vte in a case where the exposure is uniformly performed along the axial direction of the photoreceptor at the time of immediately preceding printing.

On the other hand, when the printed image is uniform, the user can easily and visually recognize the unevenness in the image caused by the image memory. However, when the printed image is not uniform, it is difficult for the user to visually recognize the unevenness in the image caused by the image memory.

Therefore, in a case where the image which has been printed immediately before is uniform and in a case where the image which is printed at this time is not uniform, the image forming apparatus 300 according to the embodiment performs printing according to the image forming condition in the normal mode from among the image forming conditions stored in the setting table 531. As an example, when determining that a density difference in a surface in a certain range of the photoreceptor (difference between maximum density and minimum density) is less than a predetermined density based on input image information, the CPU 70 determines that the image is uniform.

With this configuration, the image forming apparatus 300 can prevent that the user visually recognizes the unevenness in the image even when the image is formed under the image forming condition according to the normal mode.

(Another Configuration for Determining Whether Usable Period of Photoreceptor has Expired)

As described above, the CPU 70 is configured to change (correct) the developing bias Vd of each of the developing power supplies 60Y, 60M, 60C, and 60K and the charging bias Vcd of each of the charging power supplies 63Y, 63M, 63C, and 63K.

However, in an aspect, there is a case where the changed developing bias Vd is out of the output range of the developing power supply or a case where the changed charging bias Vcb is out of the output range of the charging power supply. In this case, the developing power supply cannot output the changed developing bias Vd or the charging power supply cannot output the changed charging bias Vcb. In a case where the developing power supply cannot output the changed developing bias Vd in this way or in a case where the charging power supply cannot output the changed charging bias Vcb, the CPU 70 determines that the usable period of the photoreceptor corresponding to the developing power supply or the charging power supply has expired.

As an example, when the high image quality mode is set, the CPU 70 may determine whether the usable period of the photoreceptor has expired based on the output range of the developing power supply or the charging power supply. As another example, when the high image quality mode is set, the CPU 70 may determine that the usable period of the photoreceptor has expired in a case where any one of the following conditions is satisfied.

(Condition 1) The film thickness d of the photoreceptor falls below a predetermined film thickness.

(Condition 2) The developing power supply cannot output the changed developing bias Vd.

(Condition 3) The charging power supply cannot output the changed charging bias Vcb.

(Surface Electrometer)

Figure 15:
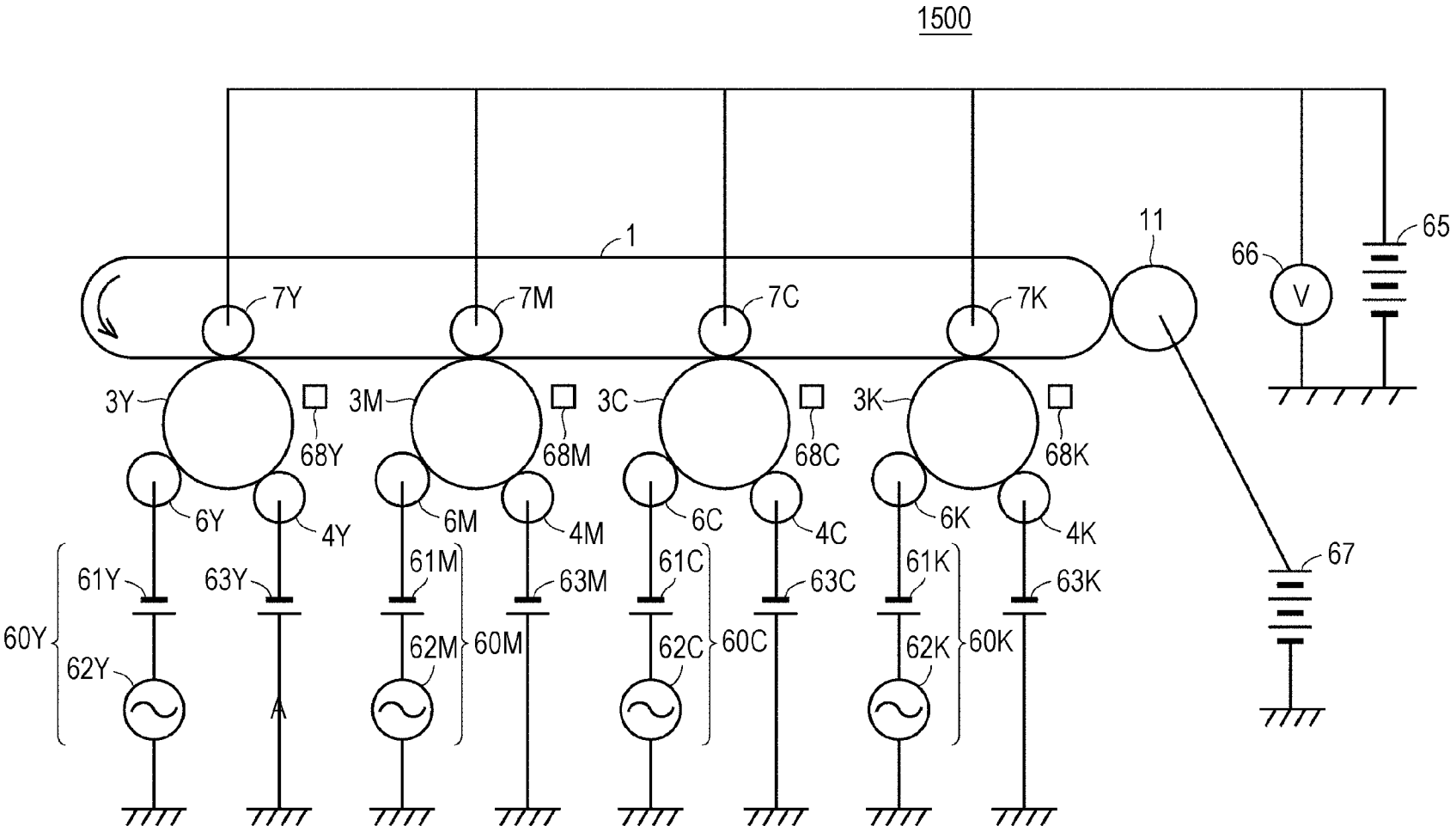
FIG. 15 illustrates a part of an internal configuration of an image forming apparatus according to another embodiment.

FIG. 15 illustrates a part of an internal configuration of an image forming apparatus 1500 according to another embodiment. The image forming apparatus 1500 is different from the image forming apparatus 300 described with reference to FIGS. 3 to 5 in that the image forming apparatus 1500 includes surface electrometers 68Y, 68M, 68C, and 68K respectively corresponding to the photoreceptors 3Y, 3M, 3C, and 3K and does not include the current sensor 64Y.

The surface electrometers 68Y, 68M, 68C, and 68K can measure surface potentials without contact at a plurality of positions according to the axial directions of the corresponding photoreceptors 3Y, 3M, 3C, and 3K. The plurality of positions corresponds to each of the exposure part and the non-exposure part.

The image forming apparatus 300 is configured to theoretically calculate the non-exposure transfer potential Vtn and the exposure transfer potential Vte. However, the image forming apparatus 1500 may actually measure the non-exposure transfer potential Vtn and the exposure transfer potential Vte using the surface electrometers 68Y, 68M, 68C, and 68K.

With this configuration, since the image forming apparatus 1500 can obtain the non-exposure transfer potential Vtn and the exposure transfer potential Vte which are more accurate than those of the image forming apparatus 300, the image forming apparatus 1500 can more effectively prevent the image memory.

Various processing described above is realized by the single CPU 70. However, the present invention is not limited to this. The various functions may be implemented by at least a single semiconductor integrated circuit as a processor, at least a single integrated circuit Application Specific Integrated Circuit (ASIC) for specific usage, at least a single Digital Signal Processor (DSP), at least a single Field Programmable Gate Array (FPGA), and/or other circuit having a computing function.

These circuits may execute various processing described above by reading one or more instructions from at least a single tangible readable medium.

Such a medium is formed as a magnetic medium (for example, hard disk), an optical medium (for example, compact disk (CD), and DVD), and any type of memory including a volatile memory and a nonvolatile memory. However, the form of the medium is not limited to these.

The volatile memory may include a Dynamic Random Access Memory (DRAM) and a Static Random Access Memory (SRAM). The nonvolatile memory may include a ROM and a NVRAM.

Although embodiments of the present invention have been described and illustrated in detail, the disclosed embodiments are made for purposes of illustration and example only and not limitation. The scope of the present invention is not defined by the above description and should be interpreted by terms of the appended claims, and it is intended that all modifications within meaning and scope equivalent to claims are included.

What is claimed is:

1. An electrophotographic image forming apparatus comprising:

an image carrier that is rotatable and carries and conveys a toner image;

a charging member that is arranged in contact with or close to the image carrier;

a charging power supply that charges the image carrier by applying a charging bias to the charging member;

an exposurer that forms a latent image on the charged image carrier;

a developing member that is arranged close to the image carrier;

a developing power supply that develops the latent image and forms a toner image on the image carrier by applying a developing bias to the developing member;

a transfer member that transfers the toner image formed on the image carrier to a medium by receiving an applied transfer bias; and a hardware processor that controls the image forming apparatus, wherein the hardware processor obtains a potential of an exposure part where the latent image is formed and a potential of a non-exposure part where the latent image is not formed, on the image carrier after the toner image has been transferred to the medium, determines the charging bias based on a difference between the obtained potentials of the exposure part and the non-exposure part so that a potential on the image carrier becomes uniform after the toner image has been transferred to the medium, and determines the developing bias based on the determined charging bias.

2. The image forming apparatus according to claim 1, wherein the hardware processor obtains the potentials of the exposure part and the non-exposure part based on a rotation speed of the image carrier and the transfer bias.

3. The image forming apparatus according to claim 2, wherein the hardware processor obtains the potentials of the exposure part and the non-exposure part based on at least one of a usage of the image carrier, a film thickness of the image carrier, and a magnitude of current flowing to the charging member.

4. The image forming apparatus according to claim 1, wherein the hardware processor determines an exposure condition of the exposurer based on the determined developing bias.

5. The image forming apparatus according to claim 4, wherein the hardware processor determines an exposure area per unit area as the exposure condition.

6. The image forming apparatus according to claim 1, wherein the hardware processor determines the developing bias so that a difference with the determined charging bias becomes a predetermined value.

7. The image forming apparatus according to claim 1, wherein the hardware processor determines the transfer bias based on a charge amount of toner forming the toner image formed on the image carrier, an adhesion amount of the toner per unit area, a rotation speed of the image carrier, and a length of the toner image in an axial direction of the image carrier.

8. The image forming apparatus according to claim 1, further comprising:

a voltage sensor that detects a magnitude of a voltage to be applied to the transfer member when a predetermined current is flowed to the transfer member, wherein the hardware processor determines the transfer bias based on measurement result of the voltage sensor.

9. The image forming apparatus according to claim 1, wherein the hardware processor determines an amount of change of the charging bias relative to a reference value based on a difference between the obtained potentials of the exposure part and the non-exposure part, and adjusts the amount of change based on at least one of image information used to form an image next and information on an image immediately before.

10. The image forming apparatus according to claim 1, further comprising:

an environmental sensor that measures at least one of temperature and humidity, wherein the hardware processor determines the charging bias based on the difference between the obtained potentials of the exposure part and the non-exposure part and measurement result of the environmental sensor.

11. The image forming apparatus according to claim 1, further comprising:

a plurality of image forming units that forms a toner image, wherein each image forming unit includes the image carrier, the charging member, and the developing member, and the hardware processor determines the charging bias and the developing bias for each image forming unit.

12. The image forming apparatus according to claim 1, wherein the hardware processor can switch a first mode and a second mode, performs control to determine the charging bias based on the difference between the potentials of the exposure part and the non-exposure part in the first mode, and does not perform control to determine the charging bias based on the difference between the potentials of the exposure part and the non-exposure part in the second mode.

13. The image forming apparatus according to claim 12, wherein the hardware processor sets an exposure output of the exposurer in the second mode to a region in which a potential of a part of the image carrier where the latent image is formed does not substantially fluctuate relative to an output of the exposurer, and sets the developing bias in the second mode to a potential necessary for supplying toner with predetermined density to the latent image in a case where the latent image is formed in the entire image carrier in the axial direction.

14. The image forming apparatus according to claim 12, wherein the hardware processor obtains a film thickness of the image carrier and determines that a usable period of the image carrier has expired in a case where the film thickness of the image carrier is less than a predetermined thickness in the second mode.

15. The image forming apparatus according to claim 1, wherein the hardware processor determines that the usable period of the image carrier has expired in a case where the charging power supply cannot output the determined charging bias or a case where the developing power supply cannot output the determined developing bias.

16. The image forming apparatus according to claim 1, wherein the hardware processor controls the charging power supply to apply a charging bias to the charging member without discharging the potential on the image carrier after the toner image has been transferred to the medium.

17. A non-transitory recording medium storing a computer readable program causing a computer of an electrophotographic image forming apparatus to perform:

obtaining a potential of an exposure part where a latent image is formed and a potential of a non-exposure part where the latent image is not formed, on an image carrier after a toner image has been transferred to a medium;

determining a charging bias to charge the image carrier based on a difference between the obtained potentials of the exposure part and the non-exposure part so that a potential on the image carrier becomes uniform after the toner image has been transferred to the medium; and determining a developing bias to develop the latent image formed on the image carrier based on the determined charging bias.

* * * * *